US010927488B2

(12) United States Patent
Funakoshi et al.

(10) Patent No.: US 10,927,488 B2
(45) Date of Patent: Feb. 23, 2021

(54) METHOD FOR REDUCING VIBRATION DURING DEHYDRATION, AND WASHING MACHINE USING SAME

(71) Applicant: Samsung Electronics Co., Ltd., Suwon-si (KR)

(72) Inventors: Hidekazu Funakoshi, Yokohama (JP); Yuji Akita, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 263 days.

(21) Appl. No.: 15/776,034

(22) PCT Filed: Feb. 25, 2016

(86) PCT No.: PCT/KR2016/001848
§ 371 (c)(1),
(2) Date: May 14, 2018

(87) PCT Pub. No.: WO2017/111203
PCT Pub. Date: Jun. 29, 2017

(65) Prior Publication Data

US 2018/0327956 A1 Nov. 15, 2018

(30) Foreign Application Priority Data

Dec. 24, 2015 (JP) ..... JP2015-252455
Feb. 19, 2016 (KR) ..... 10-2016-0019699

(51) Int. Cl.
*D06F 37/22* (2006.01)
*D06F 37/20* (2006.01)
(Continued)

(52) U.S. Cl.
CPC ..... *D06F 37/225* (2013.01); *D06F 33/00* (2013.01); *D06F 35/007* (2013.01); *D06F 37/04* (2013.01);
(Continued)

(58) Field of Classification Search
CPC ..... D06F 33/00; D06F 37/42; D06F 35/007; D06F 37/225; D06F 37/04; D06F 37/22;
(Continued)

(56) References Cited

U.S. PATENT DOCUMENTS 7,340,791 B2 3/2008 Jeong et al.
7,735,173 B2 6/2010 Kwon et al.
(Continued)

FOREIGN PATENT DOCUMENTS

JP 2010057822 A 3/2010
JP 2013034686 A 2/2013
(Continued)

OTHER PUBLICATIONS

ISA/KR, "International Search Report and Written Opinion of the International Search Authority," International Application No. PCT/KR2016/001848, dated Aug. 24, 2016, 11 pages.

*Primary Examiner* — Benjamin L Osterhout

(57) ABSTRACT

Disclosed is a method for reducing vibration during dehydration of a washing machine having a ball balancer provided to a spin basket for accommodating clothes. The disclosed method for reducing vibration comprises: a test rotation step for rotating the spin basket at a measurement rotation count, which is lower than a resonance rotation count and at which the balls of the ball balancer move in a circle; a vibration period measurement step for measuring a vibration period of the spin basket, the vibration period being caused by the eccentric distribution of the clothes in the test rotation step; and an acceleration start timing acquisition step for acquiring acceleration start timing on the basis of the vibration period such that the balls and the eccentrically distributed clothes are arranged to face each other in opposite phases during resonance, when the rotation count of the spin basket passes the resonance rotation count if there
(Continued)

is acceleration at a preset determined acceleration speed from the measurement rotation count.

20 Claims, 13 Drawing Sheets

(51) Int. Cl.

| | |
|---|---|
| ***D06F 35/00*** | (2006.01) |
| ***D06F 39/00*** | (2020.01) |
| ***D06F 37/42*** | (2006.01) |
| ***D06F 37/04*** | (2006.01) |
| ***D06F 33/00*** | (2020.01) |

(52) U.S. Cl.
CPC ..... *D06F 37/203* (2013.01); *D06F 37/22* (2013.01); *D06F 37/42* (2013.01); *D06F 39/00* (2013.01); *D06F 2202/065* (2013.01); *D06F 2202/12* (2013.01); *D06F 2204/065* (2013.01); *D06F 2222/00* (2013.01)

(58) Field of Classification Search
CPC .... D06F 37/203; D06F 39/00; D06F 2202/12; D06F 2202/065; D06F 2204/065; D06F 2222/00
See application file for complete search history.

(56) References Cited

U.S. PATENT DOCUMENTS

| | | | | |
|---|---|---|---|---|
| 8,341,787 | B2 | 1/2013 | Kim et al. | |
| 2005/0102765 | A1 | 5/2005 | Jeong et al. | |
| 2007/0186356 | A1 | 8/2007 | Kwon et al. | |
| 2008/0141731 | A1 | 6/2008 | Seiichiro et al. | |
| 2009/0183318 | A1 | 7/2009 | Kim et al. | |
| 2011/0030149 | A1* | 2/2011 | Cho | D06F 37/306 8/137 |
| 2012/0151685 | A1* | 6/2012 | Jang | D06F 37/245 8/137 |
| 2012/0192362 | A1* | 8/2012 | Lee | D06F 37/203 8/137 |
| 2013/0118210 | A1* | 5/2013 | Wee | D06F 33/00 68/12.06 |
| 2015/0013077 | A1* | 1/2015 | Jung | D06F 37/225 8/137 |
| 2015/0211168 | A1 | 7/2015 | Bonlender et al. | |

FOREIGN PATENT DOCUMENTS

| | | | |
|---|---|---|---|
| JP | 2013223621 | A | 10/2013 |
| JP | 2014079487 | A | 5/2014 |
| JP | 2016123860 | A | 7/2016 |
| KR | 10-2005-0047775 | A | 5/2005 |
| KR | 10-2006-0044135 | A | 5/2006 |
| KR | 10-0988567 | B1 | 10/2010 |
| KR | 10-1407959 | B1 | 6/2014 |
| WO | 2011-025323 | A2 | 3/2011 |

* cited by examiner

METHOD FOR REDUCING VIBRATION DURING DEHYDRATION, AND WASHING MACHINE USING SAME

CROSS-REFERENCE TO RELATED APPLICATIONS AND CLAIM OF PRIORITY

This application is a 371 National Stage of International Application No. PCT/KR2016/001848 filed Feb. 25, 2016, which claims priority to Japanese Patent Application No. JP 2015-252455 filed Dec. 24, 2015 and Korean Patent Application No. KR 10-2016-0019699 filed Feb. 19, 2016, the disclosures of which are herein incorporated by reference in their entirety.

BACKGROUND

1. Field

The present disclosure relates to a method for reducing vibration during dehydration in a washing machine and a washing machine using the same.

2. Description of Related Art

In a washing machine, when laundry is dehydrated, the laundry is pushed to one side, thereby causing a spin basket to be eccentric so that large vibration and noise are generated. In order to cope with this problem, a ball balancer is disposed in the spin basket to reduce the vibration.

The ball balancer is a member having an annular shape, and a plurality of balls are housed inside the ball balancer along with oil. When the spin basket is rotated at a higher speed than a resonance rotational speed at which resonance (primary resonance) occurs, the balls moves to face the eccentric laundry (in reverse phase). Therefore, by providing the ball balancer in the spin basket, the eccentricity may be cancelled and the vibration may be reduced.

However, when the rotational speed of the spin basket is increased to such a rotational speed, the spin basket must pass the resonance rotational speed. At that time, when the balls are positioned on the side of the eccentric laundry, a very large vibration occurs. Therefore, when the rotational speed of the spin basket passes through the resonance rotational speed, it is preferable that the eccentric laundry and the balls are opposed to each other. Various methods have been proposed for disposing the balls like this.

For example, Patent Document 1 (Japanese Patent Publication No. 2013-34686) discloses that a spin basket is rotated at a rotational speed that is lower than the resonance rotational speed and at which the balls revolve, and when the balls are opposed to the eccentric laundry, the rotational speed of the spin basket is increased once from this state to a rotational speed exceeding the resonance rotational speed.

Patent Document 2 (Japanese Patent Publication No. 2013-223621) discloses a method of controlling the arrangement of balls by adjusting the acceleration of the rotating spin basket. In detail, the spin basket is rotated at the rotational speed that is lower than the resonance rotational speed and at which the balls revolve, information such as the positions of the eccentric laundry and the balls are grasped in this state. Based on the information, the acceleration is adjusted from the relative positional relationship between the eccentric laundry and the balls being accelerated, and when the spin basket passes the resonance rotational speed, the eccentric laundry and the balls are controlled to face each other.

Patent Document 3 (Japanese Patent Publication No. 2014-79487) discloses a method of increasing the spin basket from the rotational speed in a state in which the balls are inclined to the bottom to the resonance rotational speed within a predetermined time based on conditions obtained from an experimental result.

SUMMARY

A moving angle of balls may be irregular due to a change in viscosity of oil according to temperature change or a difference in the body of the washing machine. Therefore, when controlling rotation of the balls, unless such external factors are taken into consideration, when the spin basket passes a resonance rotational speed, the position of the balls is pushed so that resonance becomes large.

In addition, while the optimal arrangement of the balls is a pin point, the rotational speed of the balls is high when the spin basket passes the resonance rotational speed so that it is not easy to allow the balls and the eccentric laundry to face each other with high accuracy by the methods of Patent Documents 1 to 3.

An object of the present disclosure is to provide a washing machine capable of allowing the eccentric laundry and the balls to face each other with high accuracy when a rotation of a spin basket passes through the resonance rotational speed and effectively reducing resonance during dehydrating.

The present disclosure may provide a method for reducing vibration during dehydrating in a washing machine provided with a ball balancer provided in a spin basket accommodating laundry. The method may include a test rotation step of rotating the spin basket at a measuring rotational speed which is lower than a resonance rotational speed and at which balls of the ball balancer revolves, a vibration period measuring step of measuring a vibration period of the spin basket, the vibration period being caused by eccentric distribution of the laundry in the test rotation step, and an acceleration start timing acquiring step of acquiring acceleration start timing based on the vibration period such that a reverse phase arrangement in which the balls and the eccentric laundry are arranged to face each other in resonance is obtained when the spin basket is accelerated from the measuring rotational speed at a predetermined acceleration and when a rotational speed of the spin basket passes the resonance rotational speed.

The measuring rotational speed may be a rotational speed when rotation of the spin basket is started and the laundry sticks to an inner circumferential surface of the spin basket and becomes impossible to move.

The vibration period of the spin basket may be measured from change in drive current which is input from a current sensor.

The acceleration start timing acquiring step may include calculating a moving angle of the balls at which the reverse phase arrangement is obtained in resonance by using a moving speed of the balls obtained from a motion equation and a time required for the rotational speed of the spin basket to be accelerated at the predetermined acceleration from the measuring rotational speed to the resonance rotational speed.

The moving angle may be less than $\pi$ radian.

The acceleration start timing acquiring step may include calculating a moving angle of the balls at which the reverse phase arrangement is obtained in the resonance by using map information in which the vibration period and the resonance rotational speed are associated with each other.

The method for reducing vibration may include an acceleration step of accelerating the rotation of the spin basket at the acceleration start timing, a vibration amount monitoring step of monitoring an amount of vibration of the spin basket in the acceleration step, a deceleration step of decelerating the rotation of the spin basket to the measuring rotational speed when the amount of vibration exceeds a predetermined value, an adjustment amount setting step of setting an adjustment amount for adjusting the acceleration start timing, a reset step of newly setting the acceleration start timing by adjusting the acceleration start timing based on the adjustment amount, and a re-acceleration step of re-accelerating the spin basket without stopping the spin basket at the reset acceleration start timing.

The adjustment amount T3, the measuring rotational speed N1, the rotational speed N2 of the spin basket when the amount of vibration exceeds the predetermined amount, a rotational speed N3 lower than the resonance rotational speed, and the acceleration $\alpha$ may be set to satisfy a condition of $T3=(N3-N2)/\alpha$.

The adjustment amount may be stored in advance in a memory section, and may be read out from the memory section in the adjustment amount setting step.

The present disclosure may provide a method for reducing vibration including (a) step of rotating a spin basket receiving laundry while keeping the spin basket at a measuring rotational speed, (b) step of obtaining a resonance rotational speed of the spin basket, (c) step of measuring a vibration period of the spin basket resulting from a relative positional relationship between eccentric laundry and balls of a ball balancer, (d) step of calculating a moving angle of the balls at which reverse phase arrangement is obtained in resonance and acquiring an acceleration start timing based on the vibration period, and (e) step of accelerating the rotation of the spin basket at the acceleration start timing, wherein the acceleration start timing may be such that the reverse phase arrangement in which the balls and the eccentric laundry face each other in resonance is obtained when the spin basket is accelerated from the measuring rotational speed at a predetermined acceleration and when a rotational speed of the spin basket passes the resonance rotational speed.

The moving angle of the balls may be an angle from a first position at which the balls exist at the acceleration start timing to a second position at which the balls exist when the measuring rotational speed of the spin basket passes through the resonance rotational speed.

The (a) step may include updating an acceleration start time based on a predetermined adjustment amount and resetting a new acceleration start time.

The present disclosure may include a re-acceleration step of re-accelerating the spin basket without stopping the spin basket at the reset acceleration start timing.

The re-acceleration step may include lengthening the acceleration start time by making a sign of the adjustment amount positive so that the acceleration starts later than the acceleration timing of the spin basket when the spin basket is accelerated at the acceleration start time and when the balls does not pass a position facing the eccentric laundry, and shortening the acceleration start time by making the sign of the adjustment amount negative so that the acceleration starts earlier than the acceleration timing of the spin basket when the spin basket is accelerated at the acceleration start time and when the balls pass the position facing the eccentric laundry.

The present disclosure may provide a washing machine including a ball balancer in a spin basket to receive laundry, the washing machine may include a motor configured to rotate the spin basket about a rotation axis, a rotational speed sensor configured to measure a rotational speed of the motor, a current sensor configured to measure a drive current of the motor, a weight sensor configured to measure a change in weight of the spin basket, and a controller configured to control the spin basket to reduce vibration by performing a test rotation step of rotating the spin basket at a measuring rotational speed which is lower than a resonance rotational speed and at which balls of the ball balancer revolves, a vibration period measuring step of measuring a vibration period of the spin basket caused by eccentric distribution of the laundry in the test rotation step, and an acceleration start timing acquiring step of acquiring acceleration start timing based on the vibration period such that a reverse phase arrangement in which the balls and the eccentric laundry face each other in resonance is obtained when the spin basket is accelerated from the measuring rotational speed at a predetermined acceleration and when a rotational speed of the spin basket passes the resonance rotational speed.

The washing machine may include the ball balancer provided in an opening of the spin basket, and the ball balancer may include a race having a hollow annular shape, oil filled in the race, and a plurality of balls immersed in the oil.

According to the vibration reduction method of the present disclosure, when the rotation of the spin basket passes through the resonance rotational speed, the eccentric laundry and the balls can be faced with each other with high accuracy, so that a washing machine capable of effectively reducing vibration during dehydrating can be provided.

DETAILED DESCRIPTION

Hereinafter, embodiments of the present disclosure will be described in detail with reference to drawing. However, the following description is merely exemplary in nature and is not intended to limit the present invention, its application, or its use.

<Configuration of Washing Machine>

Figure 1:
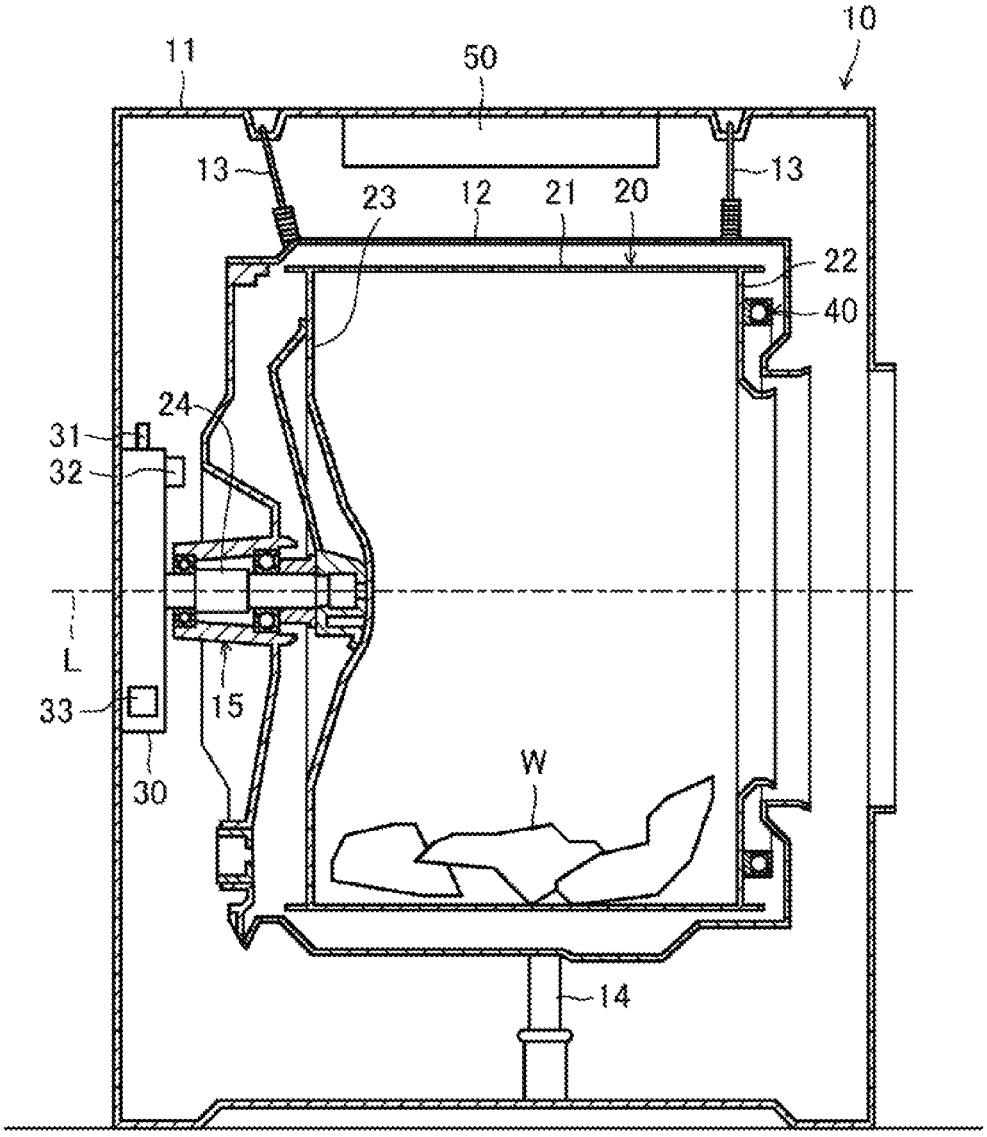
FIG. 1 is a side sectional view illustrating the construction of a washing machine according to the present embodiment.

FIG. 1 shows a washing machine according to the present embodiment. The washing machine 10 is a fully automatic drum type washing machine capable of automatically performing a series of washing, rinsing and dehydrating processes. The washing machine 10 includes a main body 11 provided on a bottom surface or the like and having an inlet on a front surface facing the lateral direction (right side in FIG. 1), a tub 12 disposed inside the main body 11, a spin basket 20 rotatably provided inside the tub 12, and a motor 30 to rotate the spin basket 20 around a rotation axis L.

The tub 12 has a bottomed cylindrical shape provided with an opening formed on the front surface thereof and is arranged so that its central axis is substantially parallel to the bottom surface or the like. The tub 12 is supported by a plurality of springs 13 and dampers 14 provided in the main body 11. A bearing 15 is provided on the bottom surface of the tub 12.

The spin basket 20 has a cylindrical side plate 21 in which a plurality of drain holes are formed and a front plate 22 and a rear plate 23 which are respectively connected to the front and rear sides of the side plate 21. The front plate 22 is provided with an opening through which laundry W may be inserted into and taken out of the spin basket 20.

Further, a main shaft 24 for rotating the spin basket 20 around the rotation axis L is provided on the rear side (left side in FIG. 1) of the rear plate 23. The main shaft 24 is supported by the bearing 15, and arranged so that the rotation axis L is aligned with the central axis of the tub 12. A ball balancer 40 is provided on the front plate 22 of the spin basket 20.

Figure 2:
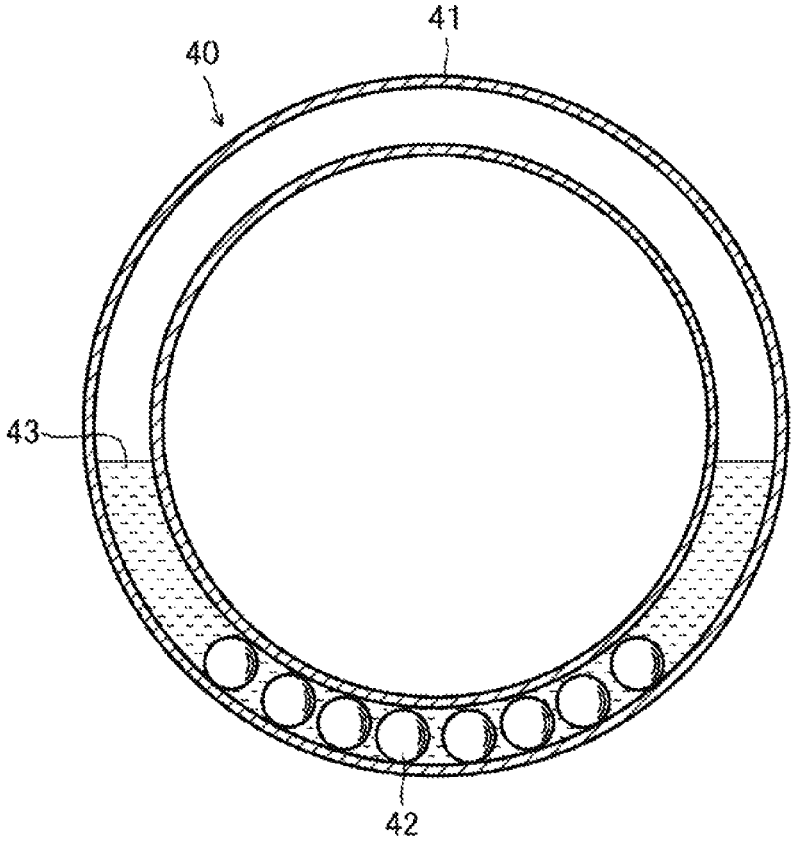
FIG. 2 is a front sectional view of a balancer.
Figure 3:
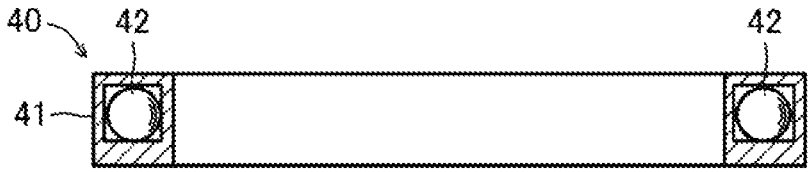
FIG. 3 is a side sectional view of a balancer.

As illustrated in FIGS. 2 and 3, the ball balancer 40 has a hollow annular race 41. Oil 43 as a viscous fluid and a plurality of balls 42 (eight in FIG. 2) are accommodated in the race 41. The ball balancer 40 is provided concentrically on the spin basket 20 with the rotation axis L as a center and is configured so that the plurality of balls 42 may revolve in accordance with the rotation of the spin basket 20.

The motor 30 is, for example, a DC motor, and rotates the main shaft 24. The motor 30 is provided with a rotational speed sensor 31 configured to measure the rotational speed thereof, a current sensor 32 configured to measure the drive current thereof, a weight sensor 33 configured to measure the weight change of the spin basket 20, or the like. The weight of the laundry W before the dehydrating treatment may be measured by using the weight sensor 33.

The measurement values measured by these sensors are output to a controller 50 provided in the main body 11. The controller 50 controls the rotation of the motor 30 in each process of washing, rinsing, and dehydrating by using these measured values.

Figure 4:
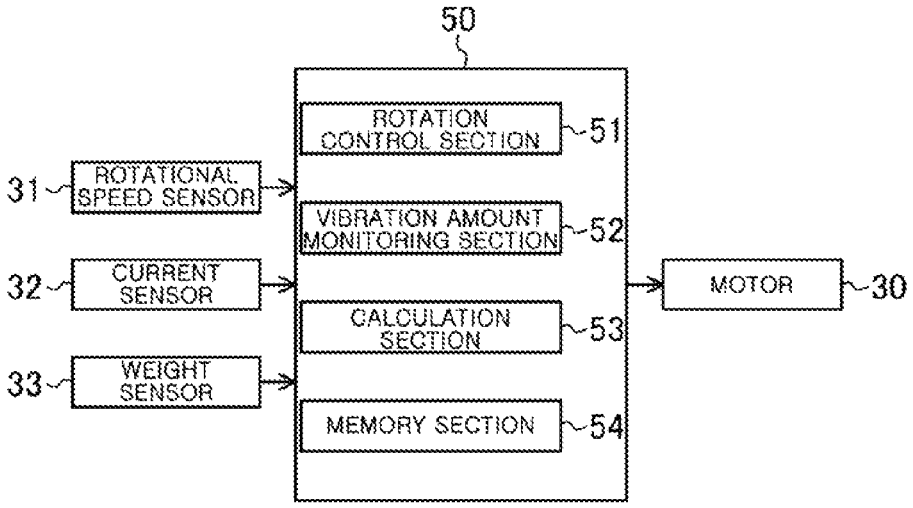
FIG. 4 is a block diagram illustrating a main configuration of a washing machine.

FIG. 4 shows a main configuration related to the controller 50. The controller 50 is provided with a rotation control section 51, a vibration amount monitoring section 52, a calculation section 53, a memory section 54, and the like. The rotation control section 51 controls the rotational operation of the motor 30 by using measurement values or the like input from the rotational speed sensor 31. The vibration amount monitoring section 52 monitors the vibration amount of the spin basket 20 by using measurement values or the like input from the current sensor 32.

The calculation section 53 performs various data processing and calculation in cooperation with the vibration amount monitoring section 52 or the memory section 54, and controls the rotation of the motor 30 in cooperation with the rotation control section 51. The memory section 54 is configured by, for example, an EEPROM and stores various data such as acceleration, map data, adjustment amount, and the like, which will be described later, and inputs/outputs information with the calculation section 53.

Figure 5:
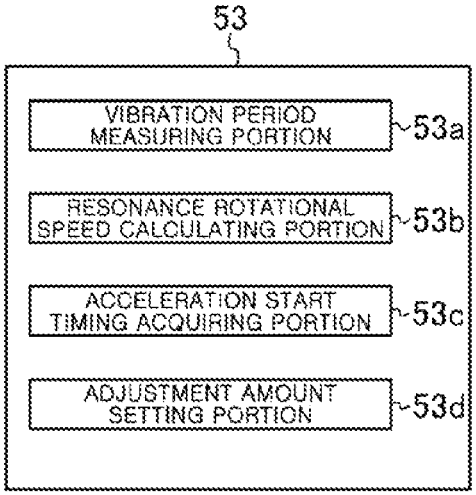
FIG. 5 is a block diagram illustrating a main configuration of a calculation section.

As illustrated in FIG. 5, the calculation section 53 is provided with a vibration period measuring portion 53*a*, a resonance rotational speed calculating portion 53*b*, an acceleration start timing acquiring portion 53*c*, an adjustment amount setting portion 53*d*, and the like. The vibration period measuring portion 53*a* measures the vibration period T1 of the spin basket 20 resulting from the relative positional relationship between the eccentric laundry and the balls 42 when the spin basket 20 is rotating at a measuring rotational speed N1.

The resonance rotational speed calculating portion 53*b* calculates the resonance rotational speed Nx of the spin basket 20 including the laundry W during the dehydrating process. The acceleration start timing acquiring portion 53*c* acquires an acceleration start timing of the spin basket 20 by which a reverse phase arrangement (reverse phase arrangement in resonance) in which the balls 42 and the eccentric laundry face each other is obtained when the rotational speed of the spin basket 20 is accelerated from the measuring rotational speed N1 and passes the resonance rotational speed Nx. The adjustment amount setting portion 53*d* sets an adjustment amount T3 used for adjusting the acceleration start timing.

(Start-up in Dehydration)

After the washing and rinsing processes are completed, the water in the tub 12 and the spin basket 20 is drained to the outside, so that the dehydrating process is performed. In the dehydrating process, the spin basket 20 is rotated at a high rotational speed (target rotational speed) of, for example, 1000 RPM or more for a predetermined time, and the laundry W is dehydrated by centrifugal force.

When the rotational speed of the spin basket 20 increases to some extent, the laundry W in the dehydrating process sticks to the inner circumferential surface of the spin basket 20 and does not move. At this time, the position where the laundry W sticks is unspecified, and normally, the laundry W is distributed in a biased state. Therefore, eccentricity occurs in the spin basket 20 (in each drawing, the position of the eccentric mass in the circumferential direction is indicated by the laundry W). In order to eliminate the eccentricity, the ball balancer 40 is provided.

Figure 6:
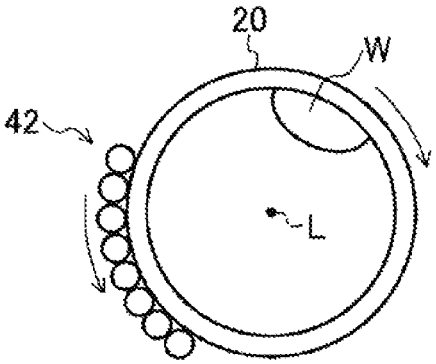
FIG. 6 is a view for explaining the operation of a spin basket and a ball balancer.

When the spin basket 20 is not rotating, the balls 42 are brought to the lower side in the vertical direction due to the action of gravity. The rotation of the spin basket 20 is started, so that the balls 42 start to move up and down. As the rotational speed of the spin basket 20 increases, the moving angle of the balls 42 also increases. Thereafter, when the centrifugal force overcomes gravity, the balls 42 revolve in a direction (counter-clockwise direction in FIG. 6) opposite to the rotational direction of the spin basket 20 (clockwise direction in FIG. 6) as illustrated in FIG. 6.

At a rotational speed lower than the resonance rotational speed Nx, the moving speed of the balls 42 is slower than the moving speed of the eccentric laundry (the rotational speed of the spin basket 20) and the relative position of the eccentric laundry and the balls 42 in the circumferential direction is varied.

At a rotational speed higher than the resonance rotational speed Nx, the balls 42 automatically move to eliminate the eccentricity. Therefore, when the spin basket 20 is rotating at such a high speed, vibration and noise are reduced.

However, in the course of raising the rotational speed of the spin basket 20 to the target rotational speed, the spin basket 20 passes the resonance rotational speed Nx. At this time, when the balls 42 are positioned on the side of the eccentric laundry, a very large vibration occurs. Therefore, the washing machine 10 is configured to perform the rotation control of the spin basket 20 so that the balls 42 and the eccentric laundry face each other with high accuracy when the rotational speed of the spin basket 20 passes the resonance rotational speed Nx.

<First Rotation Control>

Figure 7:
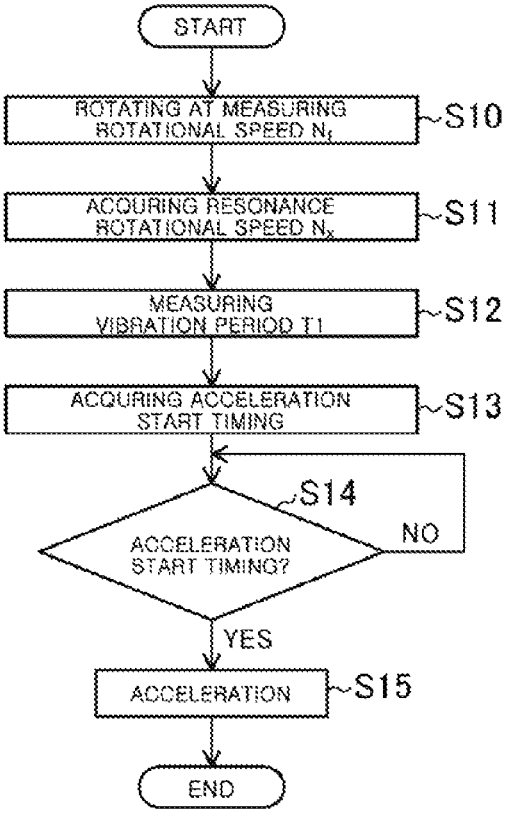
FIG. 7 is a flowchart for explaining a first rotation control.
Figure 8:
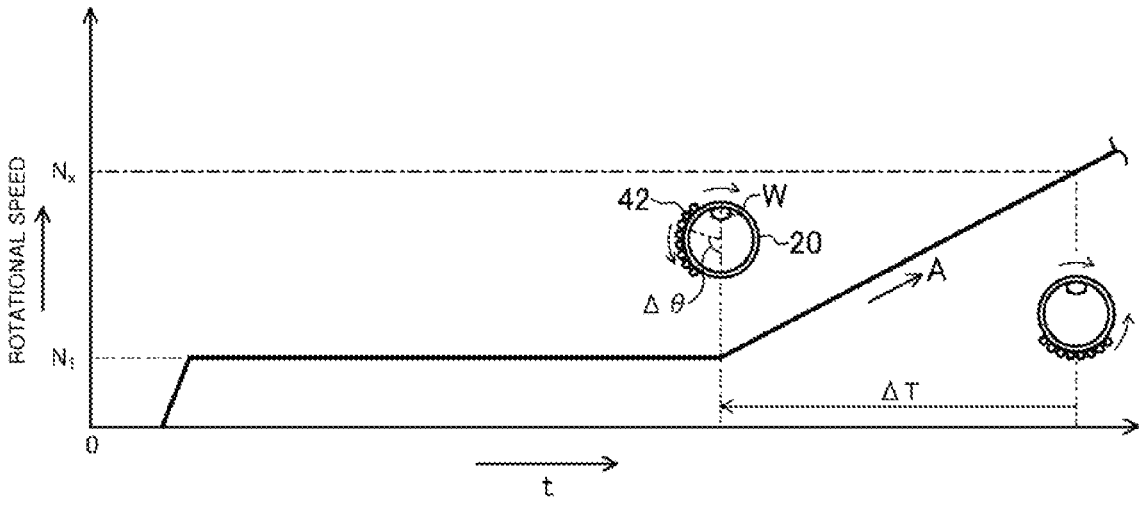
FIG. 8 is a time chart for explaining a first rotation operation.

FIG. 7 shows the flow of the rotation control (first rotation control) of the spin basket 20, and FIG. 8 shows a time chart of the rotation operation of the balls 42 at the time of the control. The first control includes a test rotation step, a resonance rotational speed measuring step, a vibration period measuring step, an acceleration start timing acquiring step, and an accelerating step.

(Test Rotation Step)

In the test rotation step, a process of rotating the spin basket 20 while keeping the spin basket 20 at a predetermined measuring rotational speed N1 is performed (step S10). The measuring rotational speed N1 is a rotational speed that is lower than the resonance rotational speed Nx and at which the balls 42 revolve, for example, 100 RPM.

The lower the rotational speed is, the larger the vibration period T1 is and the more accurate the vibration period T1 may be obtained. Therefore, the measuring rotational speed N1 is preferably as low as possible. Accordingly, in the washing machine 10, the rotational speed when the rotation is started and the laundry W sticks to the inner circumferential surface of the spin basket 20 and becomes unmovable is set as the measuring rotational speed N1.

At this time, as illustrated in FIG. 6, the balls 42 revolve at a predetermined speed in a direction opposite to the rotation direction of the spin basket 20.

(Resonance Rotational Speed Measuring step)

In the resonance rotational speed measuring step, the resonance rotational speed Nx of the spin basket 20 including the laundry W is acquired by the resonance rotational speed calculating portion 53*b* (step S11). In detail, the weight M0 of the laundry W from which most of the water has been removed is measured by the weight sensor 33, and the resonance rotational speed Nx is obtained by using the weight M0, the weight M of the spin basket 20, the spring constant k and the equation 1.

[Equation 1]

$$Nx = \sqrt{\frac{k}{M + M0}} \tag{1}$$

(Vibration Period Measuring Step)

In the vibration period measuring step, the vibration period measuring portion 53*a* measures the vibration period T1 of the spin basket 20 resulting from the relative positional relationship between the eccentric laundry and the balls 42 in the test rotation step (step S12). The vibration period measuring portion 53*a* measures the vibration period T1 of the spin basket 20 from change in the drive current that is input from the current sensor 32.

Figure 9:
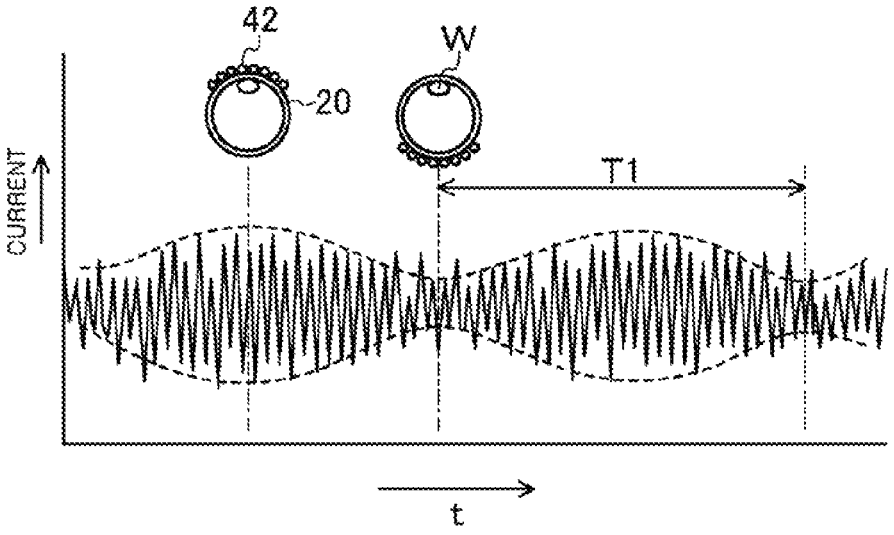
FIG. 9 is a view for explaining a vibration period.

FIG. 9 illustrates an example of the change in the drive current. In the test rotation step, since both the eccentric laundry and the balls 42 are revolving at a predetermined speed, the relative position is periodically changed. When the eccentric laundry and the balls 42 are positioned on the same side (same phase), the vibration becomes the maximum, and the amplitude of the drive current also becomes the maximum. On the other hand, when the eccentric laundry and the balls 42 face each other (reverse phase), the vibration is minimized and the amplitude of the drive current is also minimized. Since such a change occurs at a predetermined cycle, the vibration period measuring portion 53*a* measures the vibration period T1, for example, the time from the peak to the peak, etc.

The vibration period T1 changes under the influence of a change in the viscosity of the oil 43 and a difference in the body of the washing machine 10 depending on a change in temperature. Therefore, by setting the acceleration start timing using the vibration period T1 for each dehydrating process, the external factor may be excluded from the setting of the acceleration start timing, and the reverse phase arrangement in the resonance may be acquired with high accuracy.

(Acceleration Start Timing Acquiring Step)

In the acceleration start timing acquiring step, when the spin basket 20 is accelerated from the measuring rotational speed N1 at a predetermined acceleration preset in the memory section 54, the acceleration start timing acquiring portion 53*c* acquires the acceleration start timing by which the reverse phase arrangement in the resonance is obtained based on the vibration period T1 (step S13).

In detail, by using the moving speed of the balls 42 obtained from the equation of motion and the time ΔT required for the rotational speed of the spin basket 20 to be accelerated from the measuring rotational speed N1 to the resonance rotational speed Nx, a process of calculating the moving angle of the balls 42 at which the reverse phase arrangement is obtained in the resonance is performed (ball moving angle calculating step).

In the memory section 54, the following equations (2), (3), and (4) are stored.

[Equation 2]

$$mR\frac{d\omega_{Ball}}{dt} = F - \mu(mR\omega_{Ball}^2 - \mathrm{mg}\sin\omega_{Ball}t) - \mathrm{mg}\cos\omega_{Ball}t \tag{2}$$

[Equation 3]

$$\Delta T = \frac{N_x - N_1}{A} \tag{3}$$

[Equation 4]

$$\Delta\theta = \int_0^{\Delta T} \omega_{Ball}dt \tag{4}$$

The equation 2 is the equation of motion of the balls 42 revolving around the race 41. μ represents the friction coefficient of the race 41, R represents the radius of the rotation of the balls 42 (radius of the race 41), m represents the mass of the balls 42, A represents the acceleration, and ωBall represents the moving speed of the balls 42.

The equation 3 is the equation for calculating the time (acceleration start time) ΔT required for the rotational speed of the spin basket 20 to be accelerated from the measuring rotational speed N1 to the resonance rotational speed Nx. Since the acceleration A is constant, the acceleration start time ΔT is specified by the measuring rotational speed N1 and the resonance rotational speed Nx and can be easily calculated therefrom.

The equation 4 is the equation for calculating the moving angle Δθ of the balls 42 at which the reverse phase arrangement in the resonance is obtained, that is, the moving angle Δθ of the balls 42 from the position where the balls 42 exist at the acceleration start timing to the position where the eccentric laundry and the balls 42 face each other (the phase difference becomes π) when the rotational speed of the spin basket 20 passes through the resonance rotational speed Nx by using the acceleration start time ΔT calculated by the equation 3.

The acceleration start timing acquiring portion 53*c* acquires the moving angle Δθ of the balls 42 by performing calculations using these equations 2 to 4.

Further, since when the moving angle of the balls 42 is larger than π, the balls 42 passes through the eccentric laundry near the resonance rotational speed Nx so that the vibration becomes large, the moving angle Δθ of the balls 42 is preferably smaller than π. Therefore, in the washing machine 10, the acceleration A is set to be higher than a predetermined lower limit value.

In detail, the lower limit value of the acceleration A may be obtained by using the equation 3 and the following equations 5 and 6.

[Equation 5]

$$\Delta\phi = \int_{\Delta T'}^{\Delta T} \omega_{Ball} dt < \pi \tag{5}$$

[Equation 6]

$$\Delta T' = \frac{\alpha \cdot N_x - N_1}{A} \tag{6}$$

α·Nx(0<α<1) is the rotational speed in the vicinity of the resonance rotational speed Nx at which large vibration occurs when the eccentric laundry and the balls 42 are in phase with each other at a rotational speed higher than the above rotational speed and is obtained by a test or the like. The lower limit value of the acceleration A may be calculated by using these equations.

This point will be described in detail using specific examples. In addition, since it is complicated to calculate the moving speed of the balls 42 from the equation of motion, the moving speed of the balls 42 is treated as ω0 (constant).

The following equation 7 is obtained from the equation 5.

[Equation 7]

$$\Delta\phi = \int_{\Delta T'}^{\Delta T} \omega_{Ball} dt = \int_{\Delta T'}^{\Delta T} \omega_0 dt = \omega_0(\Delta T - \Delta T') < \pi \tag{7}$$

By substituting the equations 3 and 6 into the equation 7, the following equation 8 is obtained and the inequality 9 is obtained as the answer.

[Equation 8]

$$\omega_0\left(\frac{Nx - N1}{A} - \frac{Nx \cdot \alpha - N1}{A}\right) = \frac{\omega_0}{A} \cdot (1 - \alpha) \cdot Nx < \pi \tag{8}$$

[Equation 9]

$$\therefore A > \frac{\omega_0 \cdot Nx \cdot (1 - \alpha)}{\pi} \tag{9}$$

Here, assuming that the vibration period T1 is 40 seconds, the moving speed of the balls 42 is expressed by the following equation 10.

[Equation 10]

$$\omega_0 = \frac{2\pi}{T1} = \frac{2\pi}{40}[\text{rad/sec}] \tag{10}$$

Assuming that the measuring rotational speed N1 is 100 RPM, the resonance rotational speed Nx is 170 RPM, and α is 0.3, the lower limit value of the acceleration A is obtained by the following equation 11.

[Equation 11]

$$A > \frac{\omega_0 \cdot Nx \cdot (1 - \alpha)}{\pi} = \frac{\frac{2\pi}{40} \cdot 170 \cdot (1 - 0.3)}{\pi} = 5.95[\text{rpm/sec}] \tag{11}$$

(Acceleration Step)

In the acceleration step, the rotation control section 51 identifies whether or not a specific acceleration start timing is reached based on the moving angle Δθ of the balls 42 (step S14), and when the acceleration start timing is reached, the rotation control section 51 starts the acceleration of the spin basket 20 at a predetermined acceleration A (step S15).

Thereby, when the rotational speed of the spin basket 20 passes the resonance rotational speed Nx, the balls 42 and the eccentric laundry may be opposed to each other with high accuracy, so that the vibration may be effectively reduced at the time of dehydrating.

<Second Rotation Control>

Figure 10:
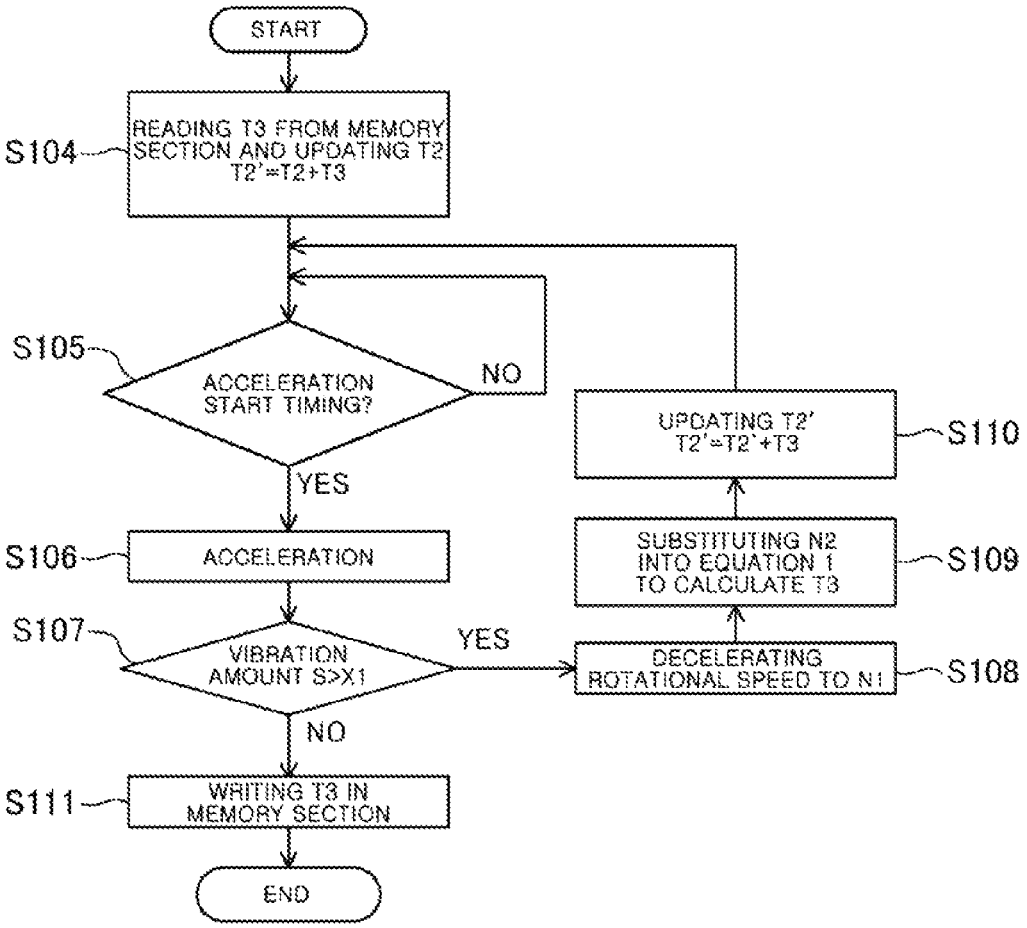
FIG. 10 is a flowchart for explaining a second rotation control.

The washing machine 10 is also configured to be able to perform a rotation control (second rotation control) for improving the accuracy by adjusting the acceleration start timing. The rotation control will be described with reference to FIGS. 10 and 11.

In the test rotation step, in order to adjust the acceleration start timing, the acceleration start timing acquiring portion 53*c* reads the adjustment amount T3 stored in the memory section 54, updates the acceleration start time T2 based on the adjustment amount T3, and sets a new acceleration start time T2' (step S 104).

Further, in the first dehydrating process, since the adjustment amount T3 is not stored in the memory section 54, the acceleration start time is T2=T2'. Thereafter, the acceleration start time T2' considering the adjustment amount T3 can be used from the beginning.

When the acceleration start timing is reached (YES in step S105), the rotation control section 51 controls the motor 30 to accelerate the spin basket 20 to the acceleration A (step S106).

The vibration amount monitoring section 52 monitors the amount of vibration S of the spin basket 20 and identifies whether or not the amount of vibration S exceeds the predetermined amount X1 when the rotational speed of the spin basket 20 passes the resonance rotational speed Nx (step S107). When the amount of vibration S does not exceed the predetermined amount X1, the adjustment amount T3 at this time is written to the memory section 54, and the processing is terminated (step S111).

Figure 11:
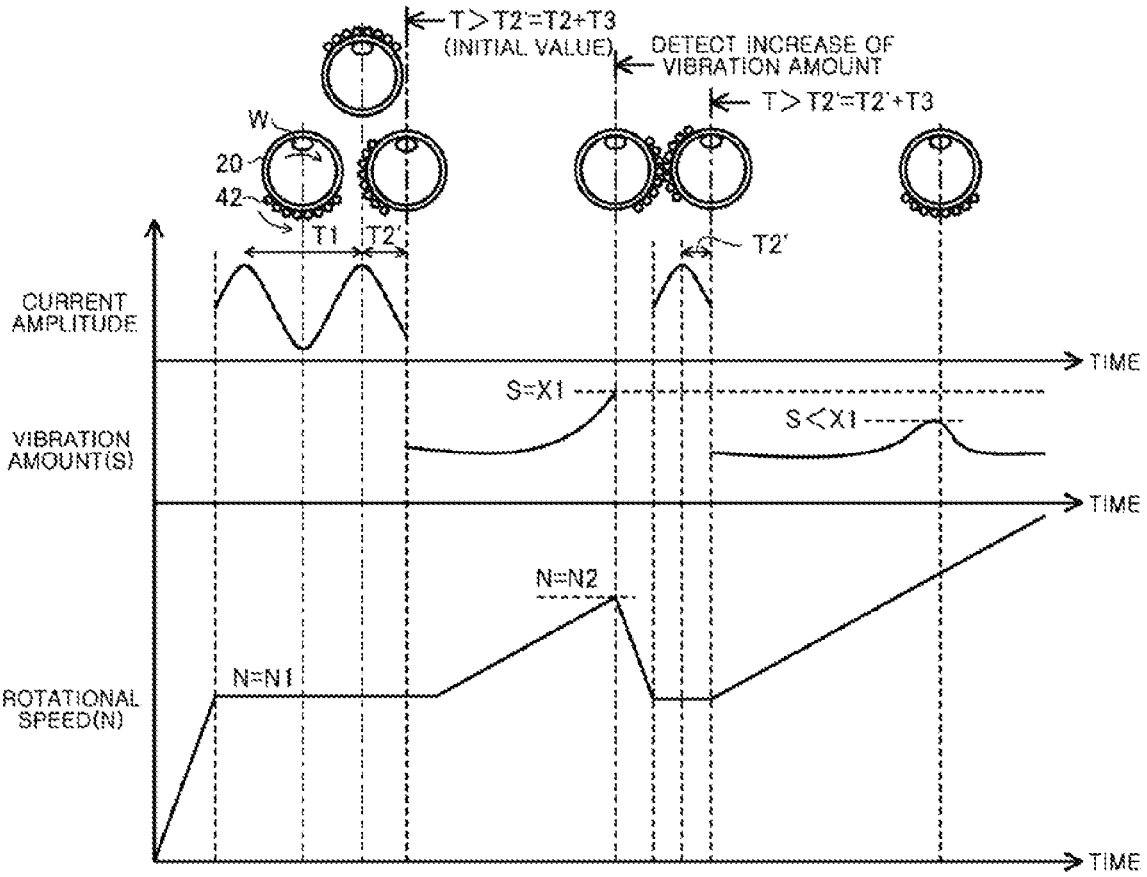
FIG. 11 is a time chart for explaining a second rotation operation.

When the amount of vibration S exceeds the predetermined amount X1, the rotation control section 51 controls the motor 30 to decelerate the rotational speed of the spin basket 20 to the measuring rotational speed N1 (step S108). In FIG. 11, the balls 42 pass through the position opposite to the phase of the eccentric laundry and move toward the same phase position with the eccentric laundry, and the amount of vibration S becomes larger than the predetermined amount X1, so that the spin basket 20 is decelerated.

The adjustment amount T3 is calculated by substituting the rotational speed N2 of the spin basket 20 when the amount of vibration S exceeds the predetermined amount X1 into the following conditional expression 1 (step S109).

$$T3=(N3-N2)/\alpha \quad (1)$$

Here, N3 is a rotational speed slightly lower than the resonance rotational speed Nx, and a is an acceleration for accelerating the spin basket 20 from the rotational speed N1 to the rotational speed N2.

The acceleration start time T2' is updated and reset based on the calculated adjustment amount T3 (step S110).

Further, in the present embodiment, when the spin basket 20 is accelerated in the acceleration start time T2', the balls 42 passes through a position facing the eccentric laundry. Therefore, at the time of re-acceleration, the acceleration start time T2' is shortened by setting the sign of the adjustment amount T3 to be negative so that acceleration is started earlier than the acceleration timing of the spin basket 20 (see FIG. 12B).

Figure 12A:
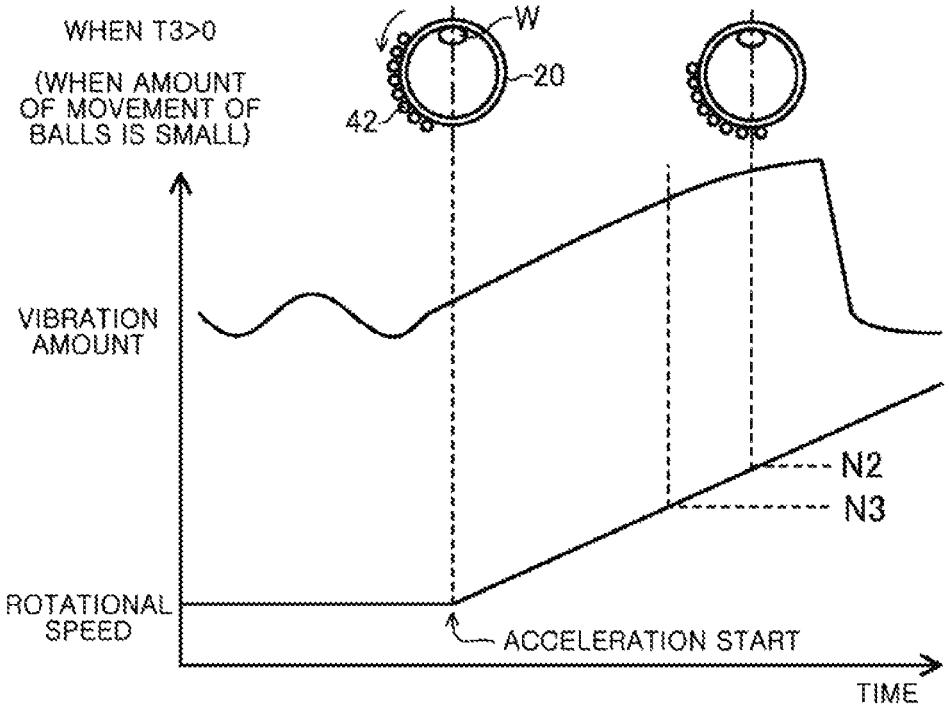
FIG. 12*a* is a schematic diagram illustrating the relationship between the relative position of eccentric laundry and balls and the sign of adjustment amount at that time (when $T3>0$).
Figure 12B:
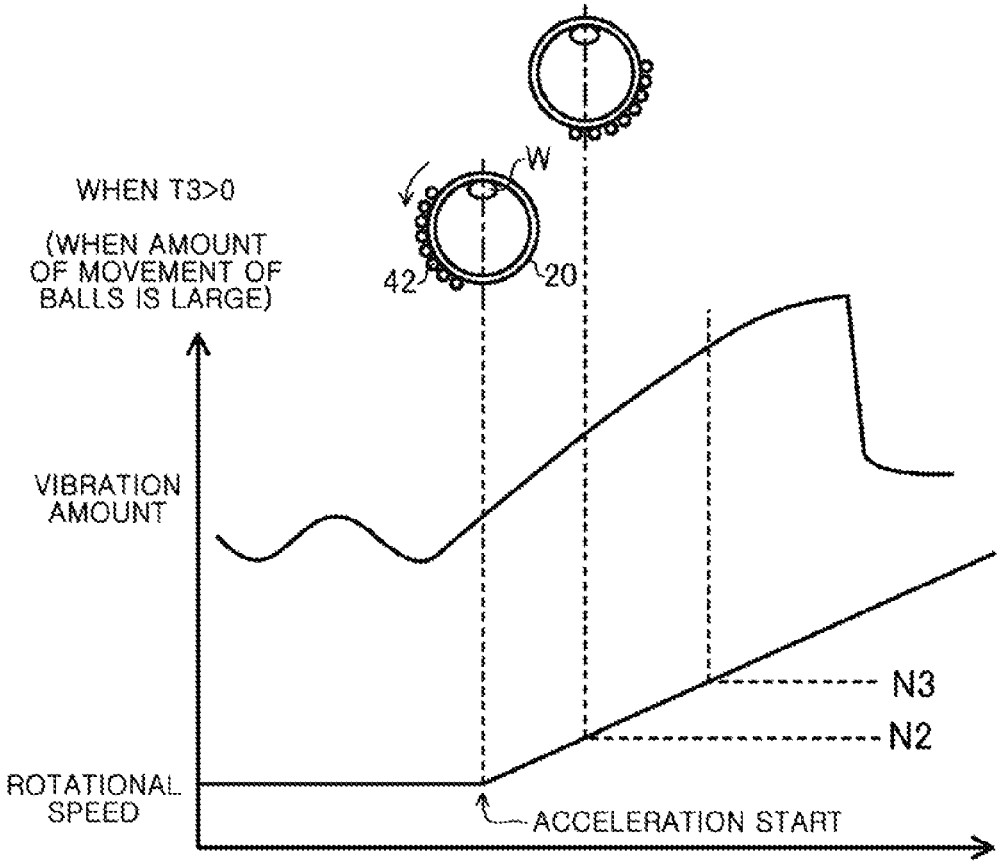
FIG. 12*b* is a schematic diagram illustrating the relationship between the relative position of eccentric laundry and balls and the sign of adjustment amount at that time (when $T3<0$).

On the other hand, when the spin basket 20 is not passing through the position facing the eccentric laundry when the spin basket 20 is accelerated at the acceleration start time T2', at the time of re-acceleration, the acceleration start time T2' is lengthened by setting the sign of the adjustment amount T3 to be positive so that the acceleration is started later than the acceleration start timing of the spin basket 20 (see FIG. 12A).

After the acceleration start time T2' is reset in step S110, the spin basket 20 is re-accelerated using the new acceleration start time T2', and the subsequent processing is continued.

As described above, according to the second rotation control, when the amount of vibration S of the spin basket 20 is increased, the rotational speed of the spin basket 20 is reduced once, and then the spin basket 20 is re-accelerated based on the new acceleration start time T2' that has been reset for reducing the amount of vibration S, so that the vibration may be reduced when passing through the resonance rotational speed Nx.

In addition, since such a re-acceleration operation is performed without stopping the spin basket 20, the time required for the dehydrating process may be shortened compared with the case where the operation to stop the spin basket 20 is performed when the amount of vibration S of the spin basket 20 is increased.

Further, the vibration reduction method according to the present disclosure is not limited to the above-described embodiment, but may include various other configurations.

In the embodiment, the motion equation or the like is used in calculation of the moving angle Δθ of the balls 42 at which the reverse phase arrangement is obtained in the resonance, but the present disclosure is not limited thereto. For example, the memory section 54 stores map information in which the vibration period T1 and the resonance rotational speed Nx are associated with each other, and the moving angle Δθ of the balls 42 by which the reverse phase arrangement is obtained in the resonance may be calculated by using the map information.

In addition, the motion equation may be substituted by the following equation 12.

[Equation 12]

$$\omega_{Ball} = \frac{2\pi}{T1} \cdot \alpha \quad (12)$$

α is the adjustment factor.

Then, since the computation processing amount can be reduced, it can be easily realized without a high processing speed and a large processing capability.

The vibration period T1 may be measured by a vibration sensor. The acceleration start timing may be obtained based on the amplitude of the vibration period T1 instead of the time of the vibration period T1.

The present disclosure relates to a vibration reducing method when dehydrating in a washing machine and a washing machine using the same.

The invention claimed is:

1. A method for reducing vibration during dehydrating in a washing machine comprising a ball balancer provided in a spin basket accommodating laundry, the method comprising:

a test rotation step of rotating the spin basket at a measuring rotational speed which is lower than a resonance rotational speed and at which balls of the ball balancer revolves;

a vibration period measuring step of measuring a vibration period of the spin basket, the vibration period being caused by eccentric distribution of the laundry in the test rotation step; and an acceleration start timing acquiring step of acquiring acceleration start timing based on the vibration period such that a reverse phase arrangement in which the balls and any eccentric laundry face each other in resonance is obtained when the spin basket is accelerated from the measuring rotational speed at a predetermined acceleration and when a rotational speed of the spin basket passes the resonance rotational speed.

2. The method for reducing vibration of claim 1, wherein the measuring rotational speed is a rotational speed when rotation of the spin basket is started and the laundry sticks to an inner circumferential surface of the spin basket.

3. The method for reducing vibration of claim 1, wherein the vibration period of the spin basket is measured from change in drive current which is input from a current sensor.

4. The method for reducing vibration of claim 1, wherein the acceleration start timing acquiring step comprises calculating a moving angle of the balls at which the reverse phase arrangement in resonance is obtained by using a moving speed of the balls and a time required for the rotational speed of the spin basket to be accelerated at the predetermined acceleration from the measuring rotational speed to the resonance rotational speed.

5. The method for reducing vibration of claim 4, wherein the moving angle is less than π radian.

6. The method for reducing vibration of claim 1, further comprising:

storing map information that associates the vibration period to the resonance rotational speed, wherein the acceleration start timing acquiring step comprises calculating a moving angle of the balls at which the reverse phase arrangement in resonance is obtained by using the map information.

7. The method for reducing vibration of claim 1, further comprising:

an acceleration step of accelerating a rotation of the spin basket at the acceleration start timing;

a vibration amount monitoring step of monitoring an amount of vibration of the spin basket in the acceleration step;

a deceleration step of decelerating the rotation of the spin basket to the measuring rotational speed when the amount of vibration exceeds a predetermined value;

an adjustment amount setting step of setting an adjustment amount for adjusting the acceleration start timing;

a reset step of newly setting the acceleration start timing by adjusting the acceleration start timing based on the adjustment amount; and a re-acceleration step of re-accelerating the spin basket without stopping the spin basket at the reset step of newly setting the acceleration start timing.

8. The method for reducing vibration of claim 7, further comprising satisfying a condition of $T3=(N3-N2)/\alpha$, wherein T3 is the adjustment amount, N2 is the rotational speed of the spin basket when the amount of vibration exceeds the predetermined value, N3 is a rotational speed lower than the resonance rotational speed, and $\alpha$ is an acceleration value for accelerating the spin basket from the measuring rotational speed to the rotational speed N2.

9. The method for reducing vibration of claim 7, further comprising:

a memory section configured to store the adjustment amount, wherein the adjustment amount setting step uses the adjustment amount read from the memory section.

10. A method for reducing vibration comprising:

(a) step of rotating a spin basket receiving laundry while keeping the spin basket at a measuring rotational speed;

(b) step of obtaining a resonance rotational speed of the spin basket;

(c) step of measuring a vibration period of the spin basket resulting from a relative positional relationship between eccentric distribution of the laundry and balls of a ball balancer;

(d) step of calculating a moving angle of the balls at which reverse phase arrangement in resonance is obtained and acquiring an acceleration start timing based on the vibration period; and (e) step of accelerating the rotation of the spin basket at the acceleration start timing, wherein the acceleration start timing is such that the reverse phase arrangement in which the balls and any eccentric laundry face each other in resonance is obtained when the spin basket is accelerated from the measuring rotational speed at a predetermined acceleration and when a rotational speed of the spin basket passes the resonance rotational speed.

11. The method for reducing vibration of claim 10, wherein the moving angle of the balls is an angle from a first position at which the balls exist at the acceleration start timing to a second position at which the balls exist when the measuring rotational speed of the spin basket passes through the resonance rotational speed.

12. The method for reducing vibration of claim 11, wherein the moving angle of the balls is less than $\pi$ radian.

13. The method for reducing vibration of claim 10, wherein the step of rotating the spin basket comprises updating an acceleration start time based on a predetermined adjustment amount and resetting a new acceleration start time.

14. The method for reducing vibration of claim 13, further comprising:

a re-acceleration step of re-accelerating the spin basket without stopping the spin basket at the new acceleration start time.

15. The method for reducing vibration of claim 14, wherein the re-acceleration step comprises:

lengthening the acceleration start time by making a sign of the predetermined adjustment amount positive so that the acceleration starts later than the acceleration timing of the spin basket when the spin basket is accelerated at the acceleration start time and when the balls do not pass a position facing any eccentric laundry, and shortening the acceleration start time by making the sign of the predetermined adjustment amount negative so that the acceleration starts earlier than the acceleration timing of the spin basket when the spin basket is accelerated at the acceleration start time and when the balls pass the position facing any eccentric laundry.

16. A washing machine including a ball balancer in a spin basket to receive laundry, the washing machine comprising:

a motor configured to rotate the spin basket about a rotation axis;

a rotational speed sensor configured to measure a rotational speed of the motor;

a current sensor configured to measure a drive current of the motor;

a weight sensor configured to measure a change in weight of the spin basket; and a controller configured to:

control the spin basket to reduce vibration by performing a test rotation step of rotating the spin basket at a measuring rotational speed which is lower than a resonance rotational speed and at which balls of the ball balancer revolve, perform a vibration period measuring step of measuring a vibration period of the spin basket caused by eccentric distribution of the laundry in the test rotation step, and perform an acceleration start timing acquiring step of acquiring acceleration start timing based on the vibration period such that a reverse phase arrangement in which the balls and any eccentric laundry face each other in resonance is obtained when the spin basket is accelerated from the measuring rotational speed at a predetermined acceleration and when a rotational speed of the spin basket passes the resonance rotational speed.

17. The washing machine of claim 16, wherein to perform the acceleration start timing acquiring step the controller is configured to calculate a moving angle of the balls at which the reverse phase arrangement in resonance is obtained by using a moving speed of the balls and a time required for the rotational speed of the spin basket to be accelerated at the predetermined acceleration from the measuring rotational speed to the resonance rotational speed.

18. The washing machine of claim 17, wherein the moving angle of the balls is less than $\pi$ radian.

19. The washing machine of claim 16, comprising a memory configured to store map information that associates the vibration period to the resonance rotational speed, wherein to perform the acceleration start timing acquiring step the controller is configured to calculate a moving angle of the balls at which the reverse phase arrangement in resonance is obtained by using map information.

20. The washing machine of claim 16, wherein the ball balancer comprises:

a race having a hollow annular shape and provided in an opening of the spin basket into which the laundry is input;

oil filled in the race; and a plurality of balls immersed in the oil.

* * * * *